US009653829B2

(12) United States Patent
Long

(10) Patent No.: US 9,653,829 B2
(45) Date of Patent: May 16, 2017

(54) PLUGGABLE MODULE FOR A COMMUNICATION SYSTEM

(71) Applicant: Tyco Electronics Corporation, Berwyn, PA (US)

(72) Inventor: Richard James Long, Columbia, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 108 days.

(21) Appl. No.: 14/599,108

(22) Filed: Jan. 16, 2015

(65) Prior Publication Data

US 2016/0211624 A1 Jul. 21, 2016

(51) Int. Cl.

| | |
|---|---|
| ***H01R 13/00*** | (2006.01) |
| ***H01R 12/71*** | (2011.01) |
| ***H01R 13/46*** | (2006.01) |
| ***H01R 13/6587*** | (2011.01) |

(52) U.S. Cl.

CPC ..... *H01R 12/716* (2013.01); *H01R 13/46* (2013.01); *H01R 13/6587* (2013.01)

(58) Field of Classification Search

CPC .. H05K 7/20436; H01R 13/665; H01R 13/46; H01R 13/6587; H01R 12/716; H01R 13/00

USPC ... 439/485, 487, 540.1, 542, 607.21–607.57, 439/620.21, 620.22, 620.23, 620.2, 486, 439/196; 361/676, 692, 831

See application file for complete search history.

(56) References Cited

U.S. PATENT DOCUMENTS

| | | | | |
|---|---|---|---|---|
| 6,441,312 | B1 * | 8/2002 | Tanimura | H05K 1/0206 174/252 |
| 6,549,405 | B2 * | 4/2003 | Wharton | H05K 7/20563 165/121 |
| 6,667,883 | B1 * | 12/2003 | Solis | H05K 7/20154 165/122 |
| 7,074,082 | B2 | 7/2006 | Kerlin et al. | |
| 7,317,617 | B2 * | 1/2008 | Meadowcroft | G02B 6/4201 165/104.33 |
| 7,457,126 | B2 * | 11/2008 | Ahrens | G02B 6/4292 257/E23.088 |
| 7,800,898 | B2 * | 9/2010 | Shuy | F21K 9/00 165/104.33 |
| 7,826,214 | B2 * | 11/2010 | Shuy | F21K 9/00 165/104.33 |
| 7,857,656 | B2 * | 12/2010 | Tai | H01R 13/50 439/485 |
| 8,300,409 | B2 * | 10/2012 | Wei | F15D 1/0005 361/689 |
| 8,328,565 | B2 | 12/2012 | Westman et al. | |

(Continued)

*Primary Examiner* — Amy Cohen Johnson
*Assistant Examiner* — Milagros Jeancharles

(57) ABSTRACT

A pluggable module includes a pluggable body extending between a mating end and a cable end. The pluggable body defines a cavity. The pluggable body includes a plurality of internal bores extending therethrough. The bores allowing airflow through an interior of the pluggable body. The pluggable module includes an internal circuit board held in the cavity. The internal circuit board is provided at an end of a cable communicatively coupled to the internal circuit board. The pluggable body is configured to be plugged into a receptacle assembly such that the internal circuit board is communicatively coupled to a communication connector of the receptacle assembly.

20 Claims, 4 Drawing Sheets

(56) References Cited

U.S. PATENT DOCUMENTS

| | | | | |
|---|---|---|---|---|
| 8,358,504 | B2 * | 1/2013 | McColloch | G02B 6/4269 361/679.46 |
| 8,597,047 | B2 * | 12/2013 | Soubh | H01R 13/6477 439/485 |
| 8,974,125 | B2 * | 3/2015 | McColloch | H04B 10/40 361/676 |
| 2006/0243427 | A1 * | 11/2006 | Kitajima | H01L 23/427 165/104.33 |
| 2011/0287658 | A1 * | 11/2011 | Yu | H01R 12/7088 439/485 |
| 2012/0058670 | A1 * | 3/2012 | Regnier | H01R 13/65802 439/485 |
| 2012/0099275 | A1 * | 4/2012 | Regnier | H05K 7/20709 361/690 |
| 2012/0202373 | A1 * | 8/2012 | Klinghult | F04B 43/046 439/485 |
| 2014/0160679 | A1 * | 6/2014 | Kelty | H05K 7/20672 361/700 |
| 2014/0321061 | A1 * | 10/2014 | Moore | H05K 3/301 361/709 |

* cited by examiner

PLUGGABLE MODULE FOR A COMMUNICATION SYSTEM

BACKGROUND OF THE INVENTION

The subject matter described herein relates to a pluggable module for a communication system.

At least some known communication systems include receptacle assemblies, such as input/output (I/O) connector assemblies, that are configured to receive a pluggable module and establish a communicative connection between the pluggable module and an electrical connector of the receptacle assembly. As one example, a known receptacle assembly includes a receptacle housing that is mounted to a circuit board and configured to receive a small form-factor (SFP) pluggable transceiver. The receptacle assembly includes an elongated cavity that extends between an opening of the cavity and an electrical connector that is disposed within the cavity and mounted to the circuit board. The pluggable module is inserted through the opening and advanced toward the electrical connector in the cavity. The pluggable module and the electrical connector have respective electrical contacts that engage one another to establish a communicative connection.

One challenge often encountered in the design of the pluggable module and receptacle assembly is the heat generated during operation of the communication system, which negatively affects module/system reliability and electrical performance. Typically, heat is generated by components on the internal circuit board within the pluggable module and drawn away from the internal circuit board by the metal body of the pluggable module. In some cases, a heat sink that is held by the receptacle assembly housing in direct contact with the metal body of the pluggable module is used to transfer the heat from the pluggable module. Air flowing through and around the receptacle assembly transfers the heat that emanates from the pluggable module. As data throughput speeds of the pluggable modules increase, more heat is generated. Conventional designs are proving to be inadequate for the required heat transfer.

Accordingly, there is a need for a pluggable module for use in a communication system that allows significant heat transfer.

BRIEF DESCRIPTION OF THE INVENTION

In an embodiment, a pluggable module is provided including a pluggable body extending between a mating end and a cable end. The pluggable body defines a cavity. The pluggable body includes a plurality of internal bores extending therethrough. The bores allowing airflow through an interior of the pluggable body. The pluggable module includes an internal circuit board held in the cavity. The internal circuit board is provided at an end of a cable communicatively coupled to the internal circuit board. The pluggable body is configured to be plugged into a receptacle assembly such that the internal circuit board is communicatively coupled to a communication connector of the receptacle assembly.

In another embodiment, a pluggable module is provided including a pluggable body extending between a mating end and a cable end. The pluggable body has a first end and an opposite second end with sides extending therebetween along a length of the pluggable body. The first end, second end and sides defining a cavity. The pluggable body including a plurality of bores in at least one of the first end, the second end and the sides. The bores being internal bores in the pluggable body allowing airflow between the mating end and the cable end such that the bores at the mating end are in flow communication with an exterior environment beyond the cable end. The pluggable module includes an internal circuit board held in the cavity. The internal circuit board is provided at an end of a cable communicatively coupled to the internal circuit board. The pluggable body is configured to be plugged into a receptacle assembly such that the internal circuit board is communicatively coupled to a communication connector of the receptacle assembly.

In a further embodiment, a communication system is provided including a pluggable module having a pluggable body extending between a mating end and a cable end. The pluggable body has a first end and an opposite second end with sides extending therebetween along a length of the pluggable body. The first end, second end and sides define a cavity. The pluggable body has a plurality of bores extending lengthwise between the mating end and the cable end. The bores are internal bores in the pluggable body. The pluggable module has an internal circuit board held in the cavity. The internal circuit board is provided at an end of a cable communicatively coupled to the internal circuit board. The communication system includes a receptacle assembly having a receptacle housing defining a module cavity with a port opening at a front end of the receptacle housing open to the module cavity. The module cavity receives the pluggable module through the port opening. The receptacle assembly has a communication connector within the receptacle housing at a rear end of the receptacle housing. The pluggable module is pluggably coupled to the communication connector such that the internal circuit board is communicatively coupled to the communication connector. The bores are open at the mating end and open at the cable end to allow airflow between exterior of the receptacle housing and interior of the receptacle housing.

DETAILED DESCRIPTION OF THE INVENTION

Embodiments set forth herein include communication systems and pluggable modules of the same. The pluggable module provides significant thermal heat transfer for the components thereof. Various embodiments of the pluggable module include a pluggable body having a cost effective design. Various embodiments of the pluggable module include a pluggable body that facilitates heat transfer. Various embodiments of the communication system include heat sink inserts that guide loading of the pluggable module into a corresponding receptacle assembly and that transfer heat away from the pluggable module body.

Unlike conventional pluggable modules that utilize riding heat sinks that are held by a receptacle assembly and that interface with a flat upper surface of the pluggable module, embodiments set forth herein have fins integral with the pluggable module body that transfer heat therefrom. The fins may have air channels therebetween that are open and allow air to flow along the fins to cool the pluggable modules. In various embodiments, the channels may receive rails of a heat sink insert to allow direct thermal connection to the pluggable module by the heat sink to draw heat away from the pluggable module body to cool the pluggable module.

Figure 1:
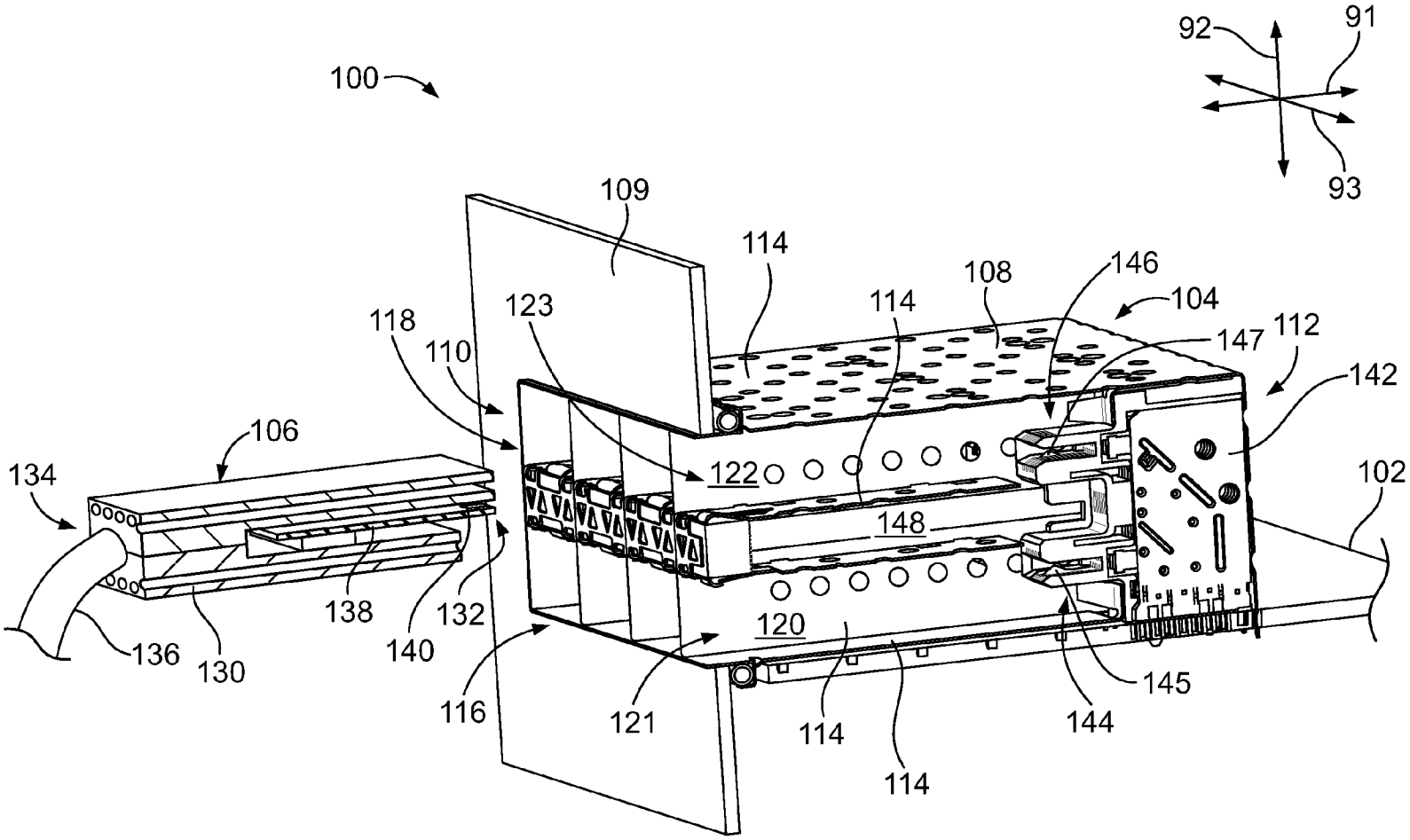
FIG. 1 is a perspective cross-sectional view of a communication system in accordance with an embodiment.

FIG. 1 is a perspective cross-sectional view of a communication system 100 in accordance with an embodiment. The communication system 100 may include a circuit board 102, a receptacle assembly 104 mounted to the circuit board 102, and one or more pluggable modules 106 that are configured to communicatively engage the receptacle assembly 104. The communication system 100 is oriented with respect to a mating or insertion axis 91, an elevation axis 92, and a lateral axis 93. The axes 91-93 are mutually perpendicular. Although the elevation axis 92 appears to extend in a vertical direction parallel to gravity in FIG. 1, it is understood that the axes 91-93 are not required to have any particular orientation with respect to gravity. Moreover, only one pluggable module 106 is shown in FIG. 1, but it is understood that multiple pluggable modules 106 may simultaneously engage the receptacle assembly 104.

The communication system 100 may be part of or used with telecommunication systems or devices. For example, the communication system 100 may be part of or include a switch, router, server, hub, network interface card, or storage system. In the illustrated embodiment, the pluggable module 106 is configured to transmit data signals in the form of electrical signals. In other embodiments, the pluggable module 106 may be configured to transmit data signals in the form of optical signals. The circuit board 102 may be a daughter card or a mother board and include conductive traces (not shown) extending therethrough.

The receptacle assembly 104 includes a receptacle housing 108 that is mounted to the circuit board 102. The receptacle housing 108 may also be referred to as a receptacle cage. The receptacle housing 108 may be arranged at a bezel or faceplate 109 of a chassis of the system or device, such as through an opening in the faceplate 109. As such, the receptacle housing 108 is interior of the device and corresponding faceplate 109 and the pluggable module(s) 106 is loaded into the receptacle housing 108 from outside or exterior of the device and corresponding faceplate 109.

The receptacle housing 108 includes a front end 110 and an opposite back end 112. The front end 110 may be provided at, and extend through an opening in, the faceplate 109. The mating axis 91 may extend between the front and back ends 110, 112. Relative or spatial terms such as "front," "back," "top," or "bottom" are only used to distinguish the referenced elements and do not necessarily require particular positions or orientations in the communication system 100 or in the surrounding environment of the communication system 100. For example, the front end 110 may be located in or facing a back portion of a larger telecommunication system. In many applications, the front end 110 is viewable to a user when the user is inserting the pluggable module 106 into the receptacle assembly 104.

The receptacle housing 108 is configured to contain or block electromagnetic interference (EMI) and guide the pluggable module(s) 106 during a mating operation. To this end, the receptacle housing 108 includes a plurality of housing walls 114 that are interconnected with one another to form the receptacle housing 108. The housing walls 114 may be formed from a conductive material, such as sheet metal and/or a polymer having conductive particles. In the illustrated embodiment, the housing walls 114 are stamped and formed from sheet metal. In some embodiments, the receptacle housing 108 is configured to facilitate airflow through the receptacle housing 108 to transfer heat (or thermal energy) away from the receptacle assembly 104 and pluggable module(s) 106. The air may flow from inside the receptacle housing 108 (for example, behind the faceplate 109) to the external environment (for example, forward of the faceplate 109) or from outside the receptacle housing 108 into the interior of the receptacle housing 108. Fans or other air moving devices may be used to increase airflow through the receptacle housing 108 and over the pluggable module(s) 106.

In the illustrated embodiment, the receptacle housing 108 includes a first (or bottom) row 116 of elongated module cavities 120 and a second (or top) row 118 of elongated module cavities 122. Each of the module cavities 120, 122 extends between the front and back ends 110, 112. The module cavities 120, 122 have respective port openings 121, 123 that are sized and shaped to receive a corresponding pluggable module 106. The module cavities 120, 122 may have the same or similar dimensions and extend lengthwise in a direction that is parallel to the mating axis 91. In the illustrated embodiment, each module cavity 122 is stacked over a corresponding module cavity 120 such that the module cavity 120 is positioned between the module cavity 122 and the circuit board 102. Any number of module cavities may be provided including a single module cavity.

In some embodiments, the pluggable module 106 is an input/output cable assembly having a pluggable body 130. The pluggable body 130 includes a mating end 132 and an opposite cable end 134. A cable 136 is coupled to the pluggable body 130 at the cable end 134. The pluggable body 130 also includes an internal circuit board 138 that is communicatively coupled to electrical wires or optical fibers (not shown) of the cable 136. The cable 136 may be communicatively coupled by directly terminating the wires to the internal circuit board 138, such as by soldering the wires to the internal circuit board. Alternatively, the cable 136 may be communicatively coupled by other processes, such as by using connectors at the end of the cable 136 and on the internal circuit board 138. The internal circuit board 138 is supported by the pluggable body 130. The circuit board 138 includes contact pads 140 at the mating end 132. In FIG. 1, the mating end 132 is configured to be inserted into the module cavity 122 of the receptacle housing 108 and advanced in a mating direction along the mating axis 91. In an exemplary embodiment, the pluggable body 130 provides heat transfer for the internal circuit board 138, such as for the electronic components on the internal circuit board 138. For example, the internal circuit board 138 is in thermal communication with the pluggable body 130 and the pluggable body 130 transfers heat from the internal circuit board 138. In an exemplary embodiment, the heat is transferred from at or near the mating end 132, such as where various electrical components are located on the internal circuit board 138, to the cable end 134. The heat is pulled out of the receptacle assembly 104 and mating end 132 and rejected to the external environment forward of the faceplate 109. In other embodiments, the heat may be drawn into other portions of the pluggable body 130 and/or the heat may be directed to other portions of the pluggable body 130, such as to the mating end 132 where the heat may be transferred to another heat sink or heat transferring component inside the chassis.

The receptacle assembly 104 includes a communication connector 142 having first and second mating interfaces 144, 146. The first mating interface 144 is disposed within the module cavity 120, and the second mating interface 146 is disposed within the module cavity 122. The first and second mating interfaces 144, 146 are aligned with the port openings 121, 123, respectively. Each of the first and second mating interfaces 144, 146 includes respective electrical contacts 145, 147 that are configured to directly engage the contact pads 140 of the pluggable module 106. Thus, a single communication connector 142 may mate with two pluggable modules 106.

In alternative embodiments, the receptacle assembly 104 does not include the stacked module cavities 120, 122 and, instead, includes only a single row of module cavities 120 or only a single module cavity 120. In such embodiments, the communication connector 142 may have a single row of mating interfaces or a single mating interface.

The pluggable module 106 is an input/output (I/O) module configured to be inserted into and removed from the receptacle assembly 104. In some embodiments, the pluggable module 106 is a small form-factor pluggable (SFP) transceiver or quad small form-factor pluggable (QSFP) transceiver. The pluggable module 106 may satisfy certain technical specifications for SFP or QSFP transceivers, such as Small-Form Factor (SFF)-8431. In some embodiments, the pluggable module 106 is configured to transmit data signals up to 2.5 gigabits per second (Gbps), up to 5.0 Gbps, up to 10.0 Gbps, or more. By way of example, the receptacle assembly 104 and the pluggable module 106 may be similar to the receptacle cages and transceivers, respectively, which are part of the SFP+ product family available from TE Connectivity.

Also shown in FIG. 1, the housing walls 114 of the receptacle housing 108 also form a separator plate 148 between the module cavities 120, 122. The separator plate 148 extends generally parallel to the mating axis 91 between the front end 110 and the back end 112. More specifically, the module cavity 120, the separator plate 148, and the module cavity 122 are stacked along the elevation axis 92. Optionally, a light-indicator assembly (not shown), such as a light pipe may be provided in the separator cavity defined by the separator plate 148. The separator cavity may allow airflow between the module cavities 120, 122 to enhance heat transfer of the pluggable modules 106 located in the module cavities 120, 122.

Figure 2:
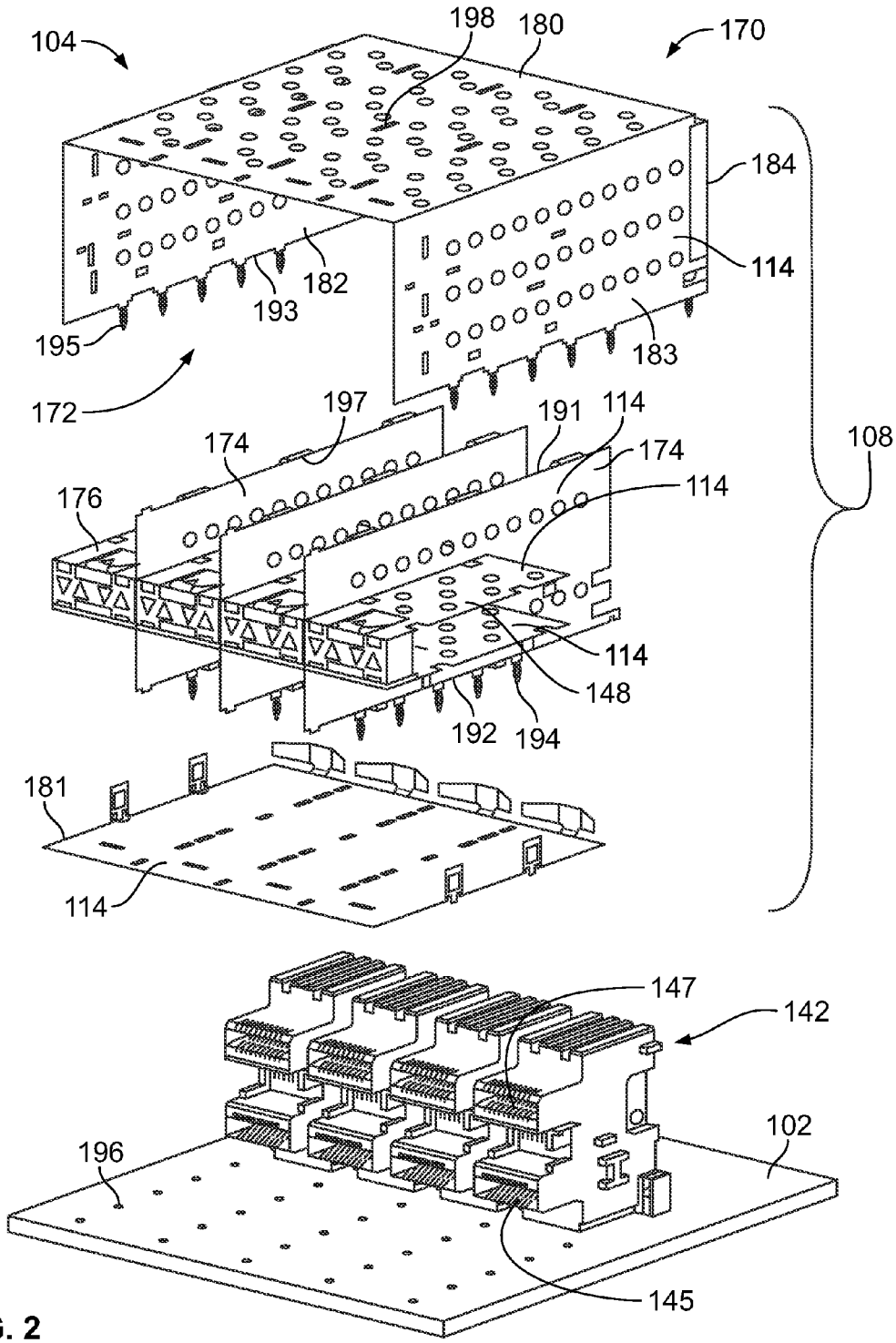
FIG. 2 is a partially exploded view of a receptacle assembly of the communication system shown in FIG. 1.

FIG. 2 is a partially exploded view of the receptacle assembly 104 and illustrates the receptacle housing 108 and a plurality of the communication connectors 142 mounted to the circuit board 102. In some embodiments, the receptacle housing 108 is formed from a plurality of interconnected panels or sheets. For example, the receptacle housing 108 includes a main panel or shell 170 that surrounds a housing cavity 172, a plurality of interior panels 174, a base panel 181, and separator panels 176 defining the separator plate 148. Each of the main panel 170, the interior panels 174, and the separator panels 176 may be stamped and formed from sheet metal. As described in greater detail below, each of the main panel 170, the interior panels 174, and the separator panels 176 may form one or more of the housing walls 114 that define the module cavity 120, the module cavity 122, and the separator plate 148 as shown in FIG. 1. As shown in FIG. 2, the main panel 170 includes an elevated wall 180, sidewalls 182, 183, and a back wall 184. The elevated wall 180 is located furthest from the circuit board 102 when the receptacle assembly 104 is constructed. The base panel 181 may rest on the circuit board 102. The sidewalls 182, 183 and the back wall 184 are configured to extend from the circuit board 102, when mounted thereto, to the elevated wall 180.

The interior panels 174 and the separator panels 176 are configured to be positioned within the housing cavity 172. Within the main panel 170, the interior panels 174 and the separator panels 176 apportion or divide the housing cavity 172 into the separate module cavities 120, 122 (FIG. 1) and the separator cavity of the separator plate 148 (FIG. 1).

In the illustrated embodiment, each of the interior panels 174 has a panel edge 191 that interfaces with the elevated wall 180 and a panel edge 192 that interfaces with the base panel 181 and/or the circuit board 102. The panel edge 192 may include mounting pins or tails 194 that are configured to mechanically engage and electrically couple to vias or thru-holes 196 of the circuit board 102. The panel edge 191 may include tabs or latches 197 that are configured to be inserted through slots 198 of the elevated wall 180 to couple to the elevated wall 180. Likewise, the sidewalls 182, 183 and the back wall 184 may have panel edges 193 that include mounting pins or tails 195 configured to mechanically engage and electrically couple to corresponding vias 196 of the circuit board 102.

The main panel 170, the base panel 181, the interior panels 174, and the separator panels 176 may comprise conductive material, such as metal or plastic. When the receptacle housing 108 is mounted to the circuit board 102, the receptacle housing 108 and the receptacle assembly 104 are electrically coupled to the circuit board 102 and, in particular, to ground planes (not shown) within the circuit board 102 to electrically ground the receptacle housing 108 and the receptacle assembly 104. As such, the receptacle assembly 104 may reduce EMI leakage that may negatively affect electrical performance of the communication system 100 (FIG. 1).

Figure 3:
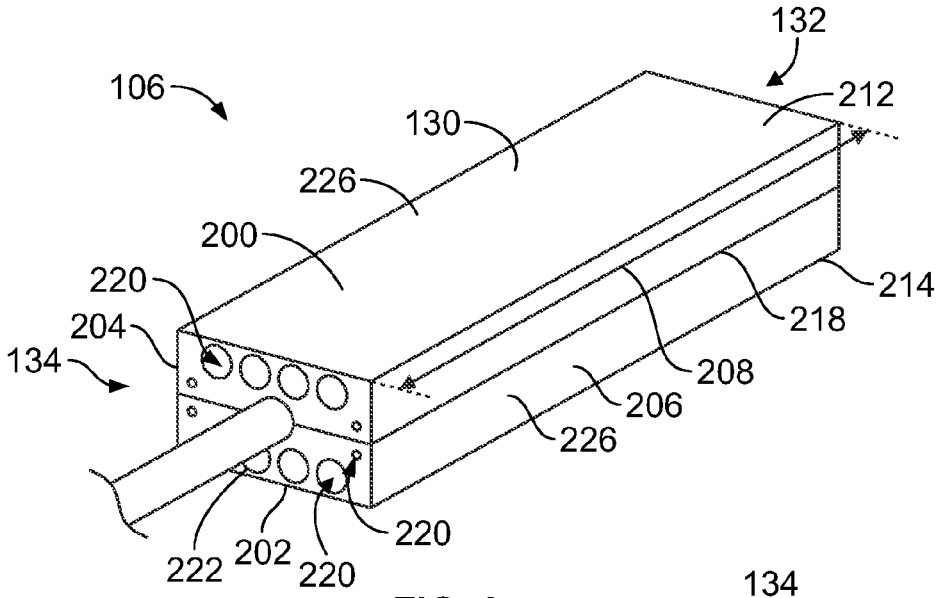
FIG. 3 is a front perspective view of a pluggable module of the communication system formed in accordance with an exemplary embodiment.
Figure 4:
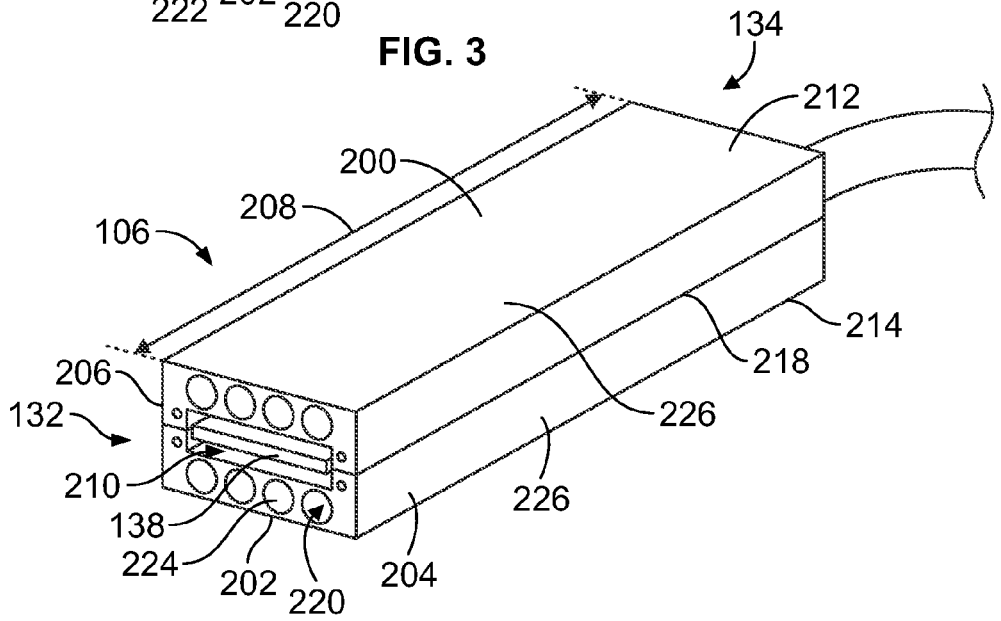
FIG. 4 is a rear perspective view of the pluggable module in accordance with an exemplary embodiment.

FIG. 3 is a front perspective view of the pluggable module 106 in accordance with an exemplary embodiment. FIG. 4 is a rear perspective view of the pluggable module 106 in accordance with an exemplary embodiment. The pluggable body 130 holds the internal circuit board 138 (shown in FIG. 4). The pluggable body 130 has a first end 200 and an opposite second end 202 with sides 204, 206 extending between the first and second ends 200, 202. The first and second ends 200, 202 and the sides 204, 206 extend lengthwise along a length 208 of the pluggable body 130 between the mating end 132 and cable end 134. The first end 200, second end 202 and sides 204, 206 define a cavity 210 (shown in FIG. 4) that holds the internal circuit board 138. Optionally, the internal circuit board 138 may be exposed at the mating end 132 for mating with the corresponding communication connector 142 (shown in FIG. 2).

In an exemplary embodiment, the pluggable body 130 includes a first shell 212 and a second shell 214. Optionally, the first shell 212 may define an upper shell and may be referred to hereinafter as upper shell 212. The second shell 214 may define a lower shell and be referred to hereinafter as lower shell 214. The upper shell 212 includes the first end 200, which defines an upper end or top of the pluggable body 130. The lower shell 214 includes the second end 202, which may define a lower end or bottom of the pluggable body 130. In an exemplary embodiment, the sides 204, 206 are defined by both the upper shell 212 and the lower shell 214.

However, in alternative embodiments, the upper shell 212 may define the sides 204, 206, or alternatively, the lower shell 214 may define the sides 204, 206. Optionally, the upper and lower shells 212, 214 may define approximately equal portions of the sides 204, 206. Alternatively, either the upper shell 212 or the lower shell 214 may define a significant majority of the sides 204, 206. In other alternative embodiments, rather than having an upper and lower shell, the pluggable body 130 may be a single unitary structure having a single shell.

The internal circuit board 138 is arranged at or near a center plane of the pluggable module 106, which may be centered between the first and second ends 200, 202. Optionally, the upper and lower shells 212, 214 may meet at or near the center plane. A seam 218 may be defined at the interface between the upper and lower shells 212, 214.

In an exemplary embodiment, the pluggable body 130 is used for heat transfer from the internal circuit board 138. The pluggable body 130 is manufactured from a thermally conductive material for efficient heat transfer. In an exemplary embodiment, the pluggable body 130 is manufactured from a metal material, such as copper, aluminum, zinc, and the like. The pluggable body 130 has a high thermal conductivity. The pluggable body 130 is placed in thermal communication with the internal circuit board 138. Heat generated by the internal circuit board 138 is drawn into the pluggable body 130 and transferred therefrom.

In an exemplary embodiment, the pluggable body 130 includes a plurality of bores 220 extending therethrough. The bores 220 are internal bores contained within the material of the pluggable body 130. The bores 220 allow airflow through the interior of the pluggable body 130, such as to cool the pluggable body 130. Optionally, the bores 220 extend lengthwise (along the length 208) between the mating end 132 and the cable end 134. The bores 220 are open at the mating end 132 and at the cable end 134 to allow air flow from exterior of the receptacle assembly 104 (shown in FIG. 1) to interior of the receptacle assembly 104, or vice versa. In alternative embodiments, the bores 220 may extend across the pluggable body 130, such as between the sides 204, 206 to allow airflow through the pluggable body 130 from one side 204 to the other side 206, or vice versa.

The bores 220 may be provided in any portion of the pluggable body 130, such as in any or all of the first end 200, the second end 202, the first side 204, and/or the second side 206. In the illustrated embodiment, the bores 220 are provided in each of the ends 200, 202 and sides 204, 206. Optionally, various sized bores 220 are provided. For example, some bores 220 may be larger, such as the bores 220 in the ends 200 and/or 202, while other bores 220 may be smaller, such as the bores 220 in the sides 204 and/or 206. The size of the bores 220 may be based on the thickness of the material of the pluggable body 130, the spacing between the bores 220, manufacturability, EMI shielding integrity, and the like. In the illustrated embodiment, the bores 220 are cylindrical; however other shapes are possible in alternative embodiments. The bores 220 may be arranged in a honeycomb pattern with thin walls separating the bores 220. The bores 220 may be polyhedrons, such as prismatoids, parallelepipeds, cuboids, hexagonal prisms, or have other shapes. Optionally, a majority of the pluggable body 130 may be bores 220 as opposed to body material to facilitate cooling of the pluggable body 130. The bores 220 may be arranged in a grid-like pattern. The bores 220 may be stacked in multiple rows above and/or below the cavity 210. Optionally, the bores 220 may be staggered, which may allow tighter spacing of the bores 220. The bores 220 may have non-uniform dimensions along the lengths of the bores 220, which may encourage increasing air flow or air volume through the bores 220 and/or may encourage cooling in particular areas, such as in the area of the heat generating components of the pluggable module 106.

The bores 220 are completely enclosed (for example, circumferentially surrounded) except at the open ends 222, 224 of the bores 220, which in the illustrated embodiment are at the mating end 132 and the cable end 134, respectively. Air flow through the bores 220 cools the material of the pluggable body 130 surrounding the bores 220. Optionally, at least some of the bores 220 may be interconnected or open to each other such that air is able to flow between the interconnected bores 220.

The pluggable body 130 includes an exterior perimeter 226 defined by exterior surfaces, such as along the ends 200, 202 and sides 204, 206. The bores 220 are arranged between the cavity 210 and the exterior perimeter 226. For example, the bores 220 are positioned radially outward a distance from the cavity 210 and radially inward a distance from the exterior perimeter 226. As such, material of the pluggable body 130 is arranged between the cavity 210 and the bores 220 and between the exterior perimeter 226 and the bores 220.

Having the pluggable body 130 comprise a plurality of the bores 220 allows more heat to be transferred by the pluggable body 130 than with conventional pluggable body shells. For example, the bores 220 are open at the cable end 134 for airflow into or out of the receptacle assembly through the bores 220 for cooling the material of the pluggable body 130. Conventional pluggable body shells are typically solid and utilize a riding heat sink that is in thermal contact with the top end of the pluggable body shell to transfer heat from the pluggable body. Heat transfer across such interface may be limited. However, the pluggable bodies 130 with the internal bores 220 will provide improved heat transfer, as compared to conventional pluggable modules. More efficient heat transfer is achieved using the internal airflow as compared to conventional shells of conventional pluggable bodies.

Figure 5:
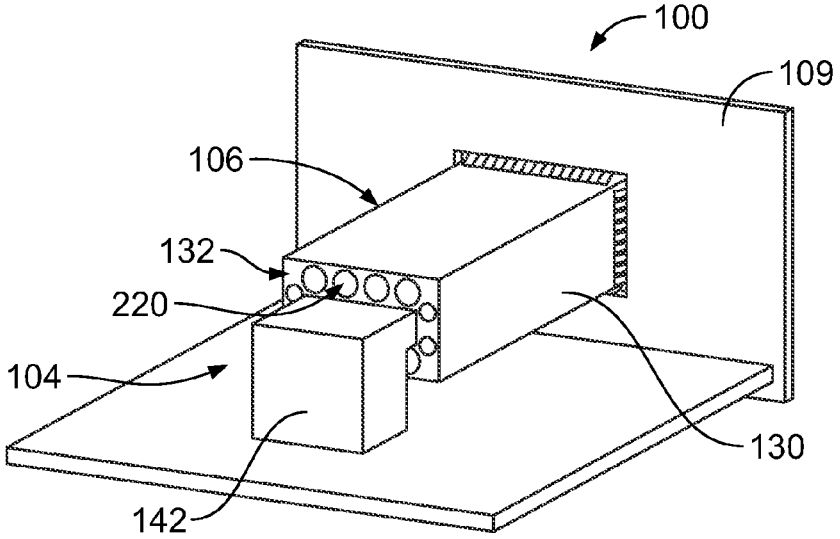
FIG. 5 is a front perspective view of the communication system in accordance with an exemplary embodiment.
Figure 6:
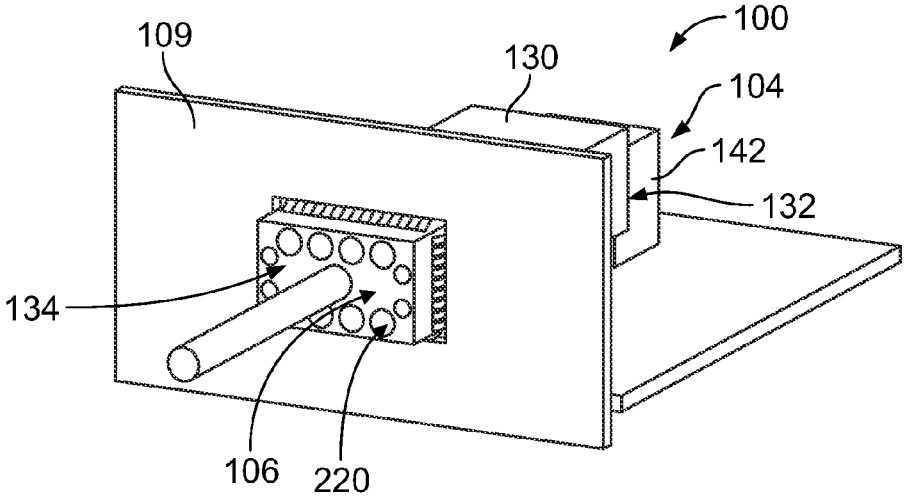
FIG. 6 is a front perspective view of the communication system in accordance with an exemplary embodiment.
Figure 7:
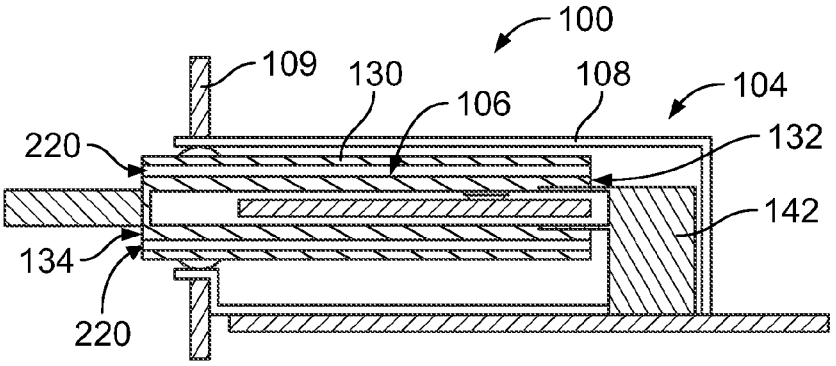
FIG. 7 is a cross-sectional view of the pluggable module and receptacle assembly in accordance with an exemplary embodiment.

FIGS. 5 and 6 are front and rear perspective views, respectively, of the communication system 100 showing a single pluggable module 106 loaded in a single port receptacle assembly 104 (shown with the corresponding receptacle housing removed for clarity to illustrate the pluggable module 106 mated with the communication connector 142). FIG. 7 is a cross-sectional view of the pluggable module 106 and receptacle assembly 104.

The pluggable module 106 passes through an opening in the faceplate 109. The receptacle assembly 104 is rearward of the faceplate 109 interior of or inside the device having the faceplate 109. In an exemplary embodiment, the faceplate 109 is conductive, such as a metal plate or bezel. The receptacle assembly 104 is configured to be electrically connected to the faceplate 109, such as using one or more gaskets. The electrical connection at the interface between the faceplate 109 and the receptacle housing 108 reduces EMI at the interface.

In an exemplary embodiment, the bores 220 are open at the cable end 134 of the pluggable body 130 such that the bores 220 may receive air from the external environment forward of the faceplate 109 or may exhaust air into the external environment forward of the faceplate 109. The bores 220 are open at the mating end 132 of the pluggable body 130 such that the bores 220 may receive air from the space around the communication connector 142 or may exhaust air into the space around the communication connector 142. The bores 220 span across the port opening of the receptacle assembly 104 and across the faceplate to allow air exchange between the interior and exterior environments of the device and/or receptacle assembly 104.

Figure 8:
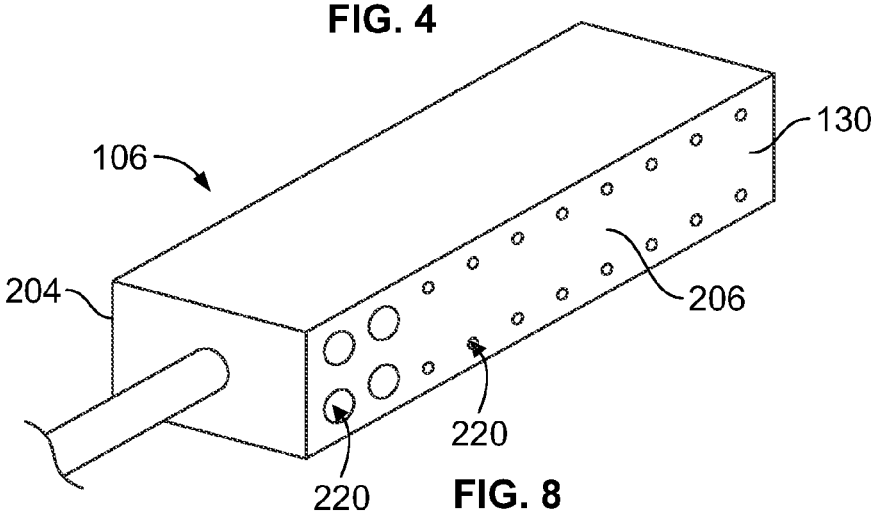
FIG. 8 is a front perspective view of a pluggable module in accordance with an exemplary embodiment.

FIG. 8 is a front perspective view of the pluggable module 106 in accordance with an exemplary embodiment. FIG. 8 shows the bores 220 extend across the pluggable body 130 from the first side 204 to the second side 206 rather than from end-to-end. Air may be forced through the receptacle housing 108 (shown in FIG. 1) such as laterally across the receptacle housing 108. Such air may flow through the pluggable body 130 to cool the pluggable body 130.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A pluggable module comprising:

a pluggable body extending between a mating end and a cable end, the pluggable body defining a cavity, the pluggable body including a plurality of internal bores extending therethrough, the bores being enclosed and extending entirely through the pluggable body such that the bores are open at opposite ends thereof to the exterior of the pluggable body, the bores allowing airflow through an interior of the pluggable body; and an internal circuit board held in the cavity, the internal circuit board being provided at an end of a cable communicatively coupled to the internal circuit board, wherein the pluggable body is configured to be plugged into a receptacle assembly such that the internal circuit board is communicatively coupled to a communication connector of the receptacle assembly.

2. The pluggable module of claim 1, wherein the bores extend length wise between the mating end and the cable end, the bores being open at the mating end and at the cable end.

3. The pluggable module of claim 1, wherein the bores allow air flow from exterior of the receptacle assembly to interior of the receptacle assembly or vice versa.

4. The pluggable module of claim 1, wherein at least some of the bores are interconnected such that air is able to flow between the interconnected bores.

5. The pluggable module of claim 1, wherein the pluggable body comprises a first end, a second end, and opposite side extending therebetween, the bores being provided in at least one of the first end, the second end, and the sides.

6. The pluggable module of claim 1, wherein the pluggable body comprises a first end, a second end, and opposite side extending therebetween, the bores being provided in each of the first end, the second end, and the sides.

7. The pluggable module of claim 1, wherein the pluggable body comprises a first end, a second end, and opposite sides extending therebetween from the mating end to the cable end, the bores being provided in at least one of the first end and the second end, the bores extending between the sides to allow airflow through the pluggable body from one side to the other side.

8. The pluggable module of claim 1, wherein the pluggable body includes an exterior perimeter, the bores being arranged between the cavity and the exterior perimeter.

9. The pluggable module of claim 1, wherein the pluggable body includes at least two different sized bores.

10. The pluggable module of claim 1, wherein the bores are arranged in a honeycomb pattern.

11. A pluggable module comprising:

a pluggable body extending between a mating end and a cable end, the pluggable body having a first end and an opposite second end with sides extending therebetween along a length of the pluggable body, the first end, second end and sides defining a cavity, the pluggable body including a plurality of bores enclosed by interior portions of the pluggable body defined between the plurality of bores, the bores extending entirely through the pluggable body such that the bores are open at opposite ends thereof to the exterior of the pluggable body, the bores being internal bores in the pluggable body allowing airflow between the mating end and the cable end such that the bores at the mating end are in flow communication with an exterior environment beyond the cable end, the bores passing cooling airflow along the interior portions of the pluggable body for the length of the pluggable body between the mating end and the cable end for cooling the pluggable body; and an internal circuit board held in the cavity, the internal circuit board being provided at an end of a cable communicatively coupled to the internal circuit board, wherein the pluggable body is configured to be plugged into a receptacle assembly such that the internal circuit board is communicatively coupled to a communication connector of the receptacle assembly.

12. The pluggable module of claim 11, wherein the bores are open at the mating end and at the cable end.

13. The pluggable module of claim 11, wherein the bores allow air flow from exterior of the receptacle assembly to interior of the receptacle assembly or vice versa.

14. A communication system comprising:

a pluggable module comprising a pluggable body extending between a mating end and a cable end, the pluggable body having a first end and an opposite second end with sides extending therebetween along a length of the pluggable body, the first end, second end and sides defining a cavity, the pluggable body having a plurality of bores extending lengthwise between the mating end and the cable end, the bores being enclosed and extending entirely through the pluggable body such that the bores are open at opposite ends thereof to the exterior of the pluggable body, the bores being internal bores in the pluggable body, and the pluggable module having an internal circuit board held in the cavity, the internal circuit board being provided at an end of a cable communicatively coupled to the internal circuit board; and a receptacle assembly having a receptacle housing defining a module cavity with a port opening at a front end of the receptacle housing open to the module cavity, the module cavity receiving the pluggable module through the port opening, the receptacle assembly having a communication connector within the receptacle housing at a rear end of the receptacle housing, the pluggable module being pluggably coupled to the communication connector such that the internal circuit board is communicatively coupled to the communication connector;

wherein the bores are open at the mating end and open at the cable end to allow airflow between exterior of the receptacle housing and interior of the receptacle housing.

15. The communication system of claim 14, wherein the bores are open at the mating end and at the cable end.

16. The communication system of claim 14, wherein the bores allow air flow from exterior of the receptacle assembly to interior of the receptacle assembly or vice versa.

17. The communication system of claim 14, wherein the bores are completely enclosed except at the mating end and the cable end.

18. The communication system of claim 14, wherein the bores are provided in each of the first end, the second end, and the sides.

19. The communication system of claim 14, wherein the pluggable body includes an exterior perimeter, the bores being arranged between the cavity and the exterior perimeter.

20. The pluggable module of claim 1, wherein the bores are enclosed by interior portions of the pluggable body, the bores passing cooling airflow along the interior portions of the pluggable body for the length of the pluggable body between the mating end and the cable end for cooling the pluggable body.

* * * * *